United States Patent [19]

Nickence

[11] 4,279,457

[45] Jul. 21, 1981

[54] COVER PLATE FOR ELECTRICAL CONNECTOR

[75] Inventor: John G. Nickence, Montgomery, Ill.

[73] Assignee: Belden Corporation, Geneva, Ill.

[21] Appl. No.: 79,716

[22] Filed: Sep. 28, 1979

[51] Int. Cl.[3] ..... H01R 13/44

[52] U.S. Cl. ..... 339/36; 339/40

[58] Field of Search ..... 339/36, 40, 41; 174/67

[56] References Cited

U.S. PATENT DOCUMENTS

| | | | |
|---|---|---|---|
| 3,068,442 | 12/1962 | Kubik et al. | 339/36 |
| 3,601,758 | 8/1971 | Davidsson | 339/36 |
| 3,812,451 | 5/1974 | Buglewicz | 339/156R |

*Primary Examiner*—Neil Abrams

*Attorney, Agent, or Firm*—Fitch, Even, Tabin, Flannery & Welsh

[57] ABSTRACT

An improved electrical connector of the type having spaced-apart plug-in receptacles is disclosed wherein a cover plate is slidably attached to the connector above the spaced-apart receptacles, the cover plate having a single pair of apertures and being of a length permitting it to be positioned upon the connector in order to selectively expose one or both receptacles or to shield both receptacles.

7 Claims, 6 Drawing Figures

COVER PLATE FOR ELECTRICAL CONNECTOR

The present invention relates to electrical connectors of the type having multiple plug-in receptacles or outlets and more particularly to such a connector being provided with a cover plate for selectively exposing or shielding the receptacles.

Electrical connectors of the type contemplated by the present invention are commonly employed to provide multiple plug-in receptacles for receiving one or more electrical plugs. As disclosed in greater detail below, the present invention particularly contemplates a connector of the extension type arranged at the end of an electrical cord for receiving one or more electrical plugs. However, it will be apparent that other types of electrical connectors are also encompassed by the present invention, for example, plug-in receptacles of the type mounted in walls or the like at a fixed location and similarly adapted for receiving one or more electrical plugs.

In all such electrical connectors, it is desirable to be able to selectively expose or shield various combinations of the receptacles. When none of the receptacles is in use, shielding is preferably provided for all of the receptacles. In addition, it is also desirable to be able to selectively expose any combination of receptacles depending upon the number which are to be used at any given time. For example, if a pair of receptacles are provided by a single connector, it may be desirable to shield both of the receptacles, to shield one receptacle and expose the other receptacle for receiving an electrical plug or to expose both receptacles when electrical plugs are to be inserted in each. A wide variety of cover plates have been provided in the prior art for electrical connectors. For example, a first class of such cover plates includes separate cover plates slidably arranged above the respective receptacles and movable either manually or by the electrical plug itself in order to expose the contact sockets for receiving the prongs of the plug. In some of these connectors, the cover plate is rotated in order to permit alignment of the prongs on the plug with the contact sockets. Most, if not all, of these prior art cover plates have been found to satisfactorily permit the individual receptacles to be either shielded or exposed depending upon whether or not each receptacle is in use. However, the prior art receptacles have been found to be relatively complex in that they include a number of moving parts with spring mechanisms and the like being provided for positioning the covers.

Accordingly, there has been found to remain a need for an improved cover plate for such electrical connectors which is of particularly simple construction with a minimum number of parts in order to assure proper operation over extended periods of time.

SUMMARY OF THE INVENTION

It is therefore an object of the invention to provide an improved electrical connector of the type having at least two plug-in receptacles with a single cover plate being movably disposed above the receptacles and formed with a single pair of apertures, the dimensions of the cover plate being selected to permit it to be positioned for alternately exposing one or both receptacles or for shielding both receptacles.

Preferably, the cover plate is slidable in alignment with the two receptacles, the arrangement of the two apertures on the cover plate permitting it to be moved to a first position with the contact sockets of the first receptacle being in register with the apertures and the second receptacle being shielded by the cover plate, a second position with the contact sockets of the second receptacle in register with the apertures and the first receptacle being unshielded by the cover plate and a third position with both receptacles being shielded by the cover plate.

In order to simplify construction of an electrical connector in accordance with the present invention, the cover plate is preferably secured in slidable relation upon a face surface of the connector by means of a tab extending from the cover plate into an elongated slot in the connector, the end of the tab being enlarged in order to assure its retention within the slot. The cover plate also preferably includes means for moving the plate to various positions as described above.

An electrical connector as contemplated by the present invention is preferably of an extension type mounted at the end of an electrical cord for receiving one or more electrical plugs. However, as noted above, the invention also contemplates other electrical connectors such as wall mounted plug-in receptacles or outlets including a similarly constructed cover plate.

Additional objects and advantages of the invention are made apparent in the following description having reference to the accompanying drawings.

DESCRIPTION OF THE PREFERRED EMBODIMENT

Figure 1:
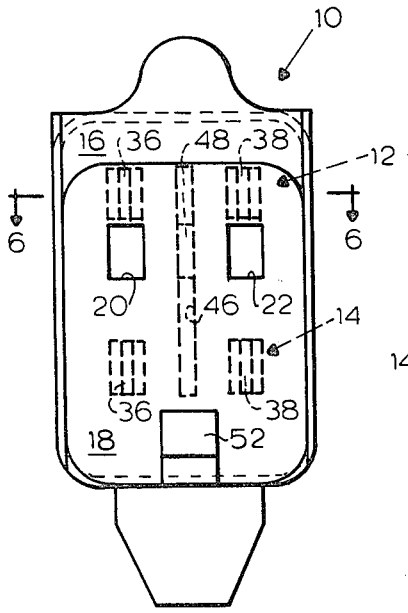
FIGS. 1–3 are similar plan views of an extension type electrical connector provided with a cover plate according to the present invention, the cover plate being positioned in FIG. 1 to shield both of a pair of plug-in receptacles in the connector, the cover plate being positioned in FIG. 2 to uncover one receptacle and to place a pair of apertures in the cover plate in register with the other receptacle, the cover plate being positioned in FIG. 3 to place the apertures in register with the one receptacle while shielding the other receptacle.
Figure 2:
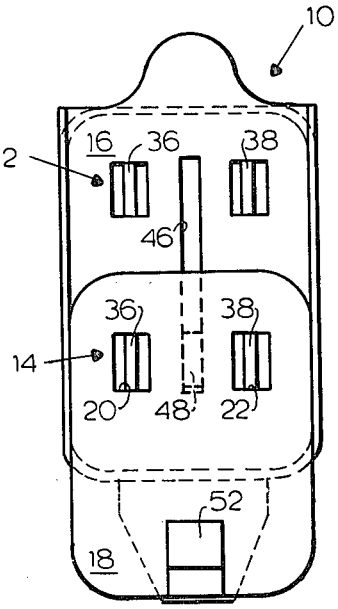
Figure 3:
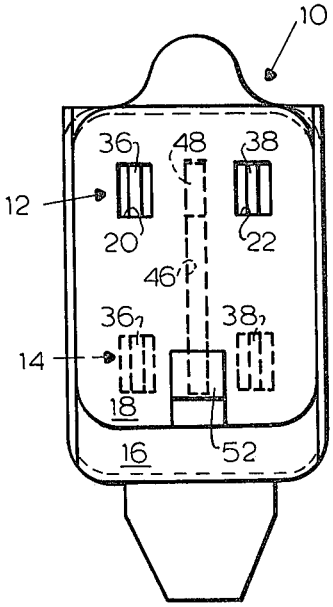
Figure 4:
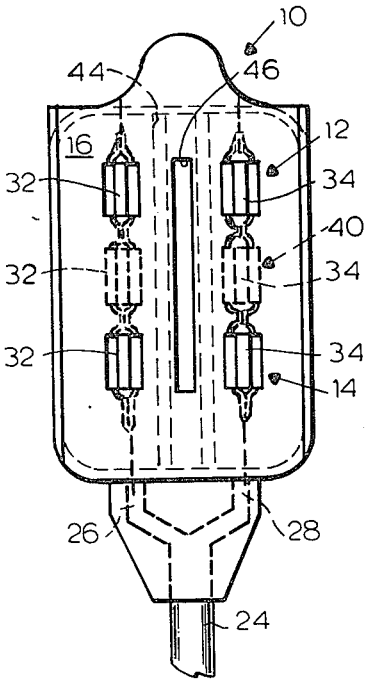
FIG. 4 is a plan view of an electrical connector similar to those of FIGS. 1–3 with the cover plate removed to better illustrate the electrical contact components within the connector.
Figure 5:
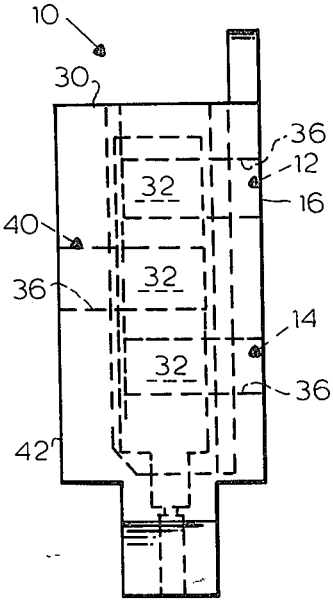
FIG. 5 is a side view of the electrical connector of FIG. 4 without the cover plate.

Referring now to the drawings and particularly to FIGS. 1–3, the present invention contemplates an electrical connector, generally indicated at 10, having a pair of spaced-apart receptacles 12 and 14 disposed upon one surface 16 of the connector. As will be described in greater detail below, the connector 10 is preferably of a type having additional receptacles as illustrated in FIGS. 4 and 5. A single cover plate 18 is slidably mounted upon the connector 10 above the surface 16 and includes a single pair of apertures 20 and 22. The arrangement of the apertures upon the cover plate and the dimensions of the cover plate are selected so that the cover plate may be positioned to selectively and alternatively expose one or both receptacles or to shield both receptacles.

Referring now to FIGS. 4 and 5, the connector 10 is preferably of an extension or cube type for mounting at the end of an electrical cord or line 24. The electrical conductors 26 and 28 within the cord 24 are separated within the connector body 30 to form a conventional parallel circuit with opposite contacts 32 and 34 in each receptacle. Separate sockets 36 and 38 are formed by the connector body 30 in register with each of the contacts 32 and 34. In the preferred connector embodiment of FIGS. 4 and 5, the outermost receptacles 12 and 14 are formed with their sockets 36 and 38 extending to the common surface 16. The sockets 36 and 38 for the central receptacle 40 extend to an opposite surface 42 of the connector body to facilitate interconnection of electrical plugs into each of the receptacle cells. It is noted that a single cover plate is provided to selectively shield or expose the sockets for the two receptacles 12 and 14 opening through the connector surface 16. Although no cover plate is shown for the other receptacle 40, it will be apparent that cover plate means could also be provided for this receptacle in order to selectively shield or expose its contact sockets.

Figure 6:
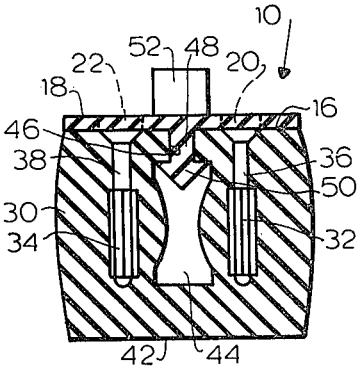
FIG. 6 is a view taken along section line VI—VI of FIG. 1.

Referring now to FIG. 6 as well as to FIGS. 1–3, the connector body 30 is formed with an elongated chamber 44 extending in alignment between the sockets of the two receptacles 12 and 14. A slot 46 interconnects the chamber 44 with the connector surface 16. The cover plate 18 is formed with a tab 48 which extends through the slot 46 and has an enlarged end portion 50 which is captured in the chamber 44 while permitting the cover plate 18 to be slidably moved above the surface 16. Referring particularly to FIG. 6, it may be seen that the chamber 44 is preferably of symmetrical construction. Thus, a similar slot could be formed between the chamber and the opposite surface 42 in order to permit a similar slidable cover plate to be arranged above that surface for selectively shielding or exposing the sockets for the other receptacle 40.

As illustrated in FIGS. 1–3, the length of the cover plate 18 is sufficient to span or simultaneously shield the sockets for both of the receptacles 12 and 14. The apertures 20 and 22 are arranged upon the cover plate in alignment with the sockets 36 and 38 respectively. However, the apertures 20 and 22 are arranged upon the cover plate so that they are not in register with either of the receptacles when the cover plate 18 is positioned as illustrated in FIG. 1. Through this arrangement, the single cover plate 18 may then be moved downwardly to a position illustrated in FIG. 2 where the one receptacle 12 is exposed or uncovered by the cover plate while the sockets for the other receptacle 14 are in register with the apertures 20 and 22. Accordingly, with the cover plate in the position illustrated in FIG. 2, both receptacles are available for use. Alternatively, the cover plate may also be shifted upwardly to the position illustrated in FIG. 3 where the apertures 20 and 22 are in register with the sockets for the first receptacle 12 while the other receptacle 14 is shielded or closed by the cover plate itself.

The cover plate 18 also includes a projection 52 upon its upper surface opposite the connector to permit manipulation of the cover plate into the various positions illustrated in FIGS. 1–3. Preferably, both the projection 52 and the tab 48 and end projection 50 on the other side of the cover plate are formed as integral portions of the cover plate. The cover plate is preferably formed from insulating material such as a suitable plastic for example.

Numerous modifications and variations will be apparent from the preceding description within the scope of the present invention. For example, the receptacles 12, 14 and 40 may be of a polarized design requiring proper alignment of the electrical plug for operation. Accordingly, the scope of the present invention is defined only by the following appended claims.

What is claimed is:

1. In an electrical connector of the type having first and second spaced-apart plug-in receptacles, each receptacle including a pair of contact sockets for selectively receiving the prongs of a plug-type connector, the improvement comprising a cover plate attached to the electrical connector in longitudinally slidable relation above the spaced-apart receptacles, the cover plate having a length sufficient to cover or shield both receptacles, the cover plate forming a single pair of apertures arranged in longitudinal alignment with the contact sockets of each receptacle, said apertures being located along the length of the cover plate to permit the cover plate to be slidably moved respectively to a first position shielding both receptacles, a second position simultaneously exposing one receptacle and shielding the other receptacle and a third position with both of the spaced-apart receptacles being exposed.

2. The electrical connector of claim 1 wherein the arrangement of said apertures on the cover plate permits the cover plate to be moved to a first position with the contact sockets of the first receptacle being in register with the apertures and the second receptable being shielded by the cover plate, the cover plate also being movable to a second position with the contact sockets of the second receptacle being in register with the apertures and the first receptacle being unshielded by the cover plate, the cover plate also being movable to a third position with both receptacles being shielded by the cover plate.

3. The electrical connector of claim 2 wherein the cover plate is slidably secured to the connector by means of a tab extending from the cover plate through an elongated slot formed by the connector in central alignment between the receptacles.

4. The electrical connector of claim 3 being adapted for connection with an electrical cord and having an additional receptacle including sockets in communication with an opposite surface of the connector.

5. The electrical connector of claim 4 wherein a body portion of the connector forms an elongated chamber in communication with the slot, the tab on the cover plate having an enlarged end portion captured within the chamber.

6. The electrical connector of claim 1 wherein the cover plate is slidably secured to the connector by means of a tab extending from the cover plate through an elongated slot formed by the connector in central alignment between the receptacles.

7. The electrical connector of claim 6 wherein a body portion of the connector forms an elongated chamber in communication with the slot, the tab on the cover plate having an enlarged end portion captured within the chamber.

* * * * *